US006084186A

United States Patent [19]

Shaffer

[11] Patent Number: 6,084,186

[45] Date of Patent: Jul. 4, 2000

[54] SAFETY SWITCH

[76] Inventor: Thomas E. Shaffer, 10745 Squawbush Loop, Peyton, Colo. 80831

[21] Appl. No.: 09/313,327

[22] Filed: May 17, 1999

[51] Int. Cl.[7] ..... H01H 9/20

[52] U.S. Cl. ..... 200/43.16; 200/322; 200/335

[58] Field of Search ..... 200/43.01, 43.11, 200/43.13, 43.15, 43.16–43.18, 566, 318, 321–325, 329, 332, 334, 335

[56] References Cited

U.S. PATENT DOCUMENTS

| | | | |
|---|---|---|---|
| 3,057,223 | 10/1962 | Korsgren, Jr. | 74/491 |
| 3,604,868 | 9/1971 | Batcheller et al. | 200/67 G |
| 4,121,065 | 10/1978 | Woodard | 200/42 T |
| 4,480,159 | 10/1984 | Kirchoff | 200/42 T |
| 4,942,272 | 7/1990 | Sorenson | 200/43.16 |
| 5,380,964 | 1/1995 | Easton et al. | 200/43.01 |

*Primary Examiner*—Michael Friedhofer
*Attorney, Agent, or Firm*—G. F. Gallinger

[57] ABSTRACT

A safety residential lever arm switch which can only be thrown when the lever arm is first depressed. In an electrical switch of the type having a front housing having a central frontal opening, a lever arm positioned within the front housing and projecting through the frontal opening, and a rear housing having a front side portion adapted to mate with the front housing, a safety feature comprising: structure requiring an outward end portion of the lever arm to be pushed inwardly before it can be pivoted so that a user may, with a single hand, first depress the lever arm, and then pivot the lever arm between on and off position. A button end portion of a shaft extending from an outward end portion of the lever arm is first depressed. Alternatively, the lever arm in its entirety is depressed inwardly so that the switch can then be thrown.

16 Claims, 1 Drawing Sheet

SAFETY SWITCH

FIELD OF INVENTION

Figure 1:
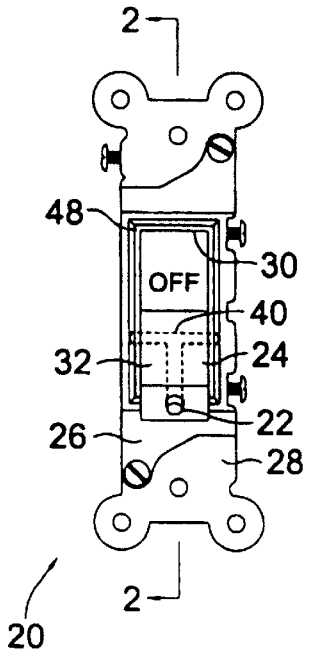

This invention relates to safety switches which have locking devices to prevent them from accidentally being thrown. More particularly this invention relates to a safety residential lever arm switch. The lever arm can only be thrown when it is first depressed.

BACKGROUND OF THE INVENTION

The inventor is an electrician who has young children. He witnessed one of his children turn on the garbage disposal while the other was reaching into it. Adults are frequently startled when they mistakenly switch on the garbage disposal. Motion sensor lamps need to be left in an on position. VCRs and other standby electronic equipment on switched receptacles need to remain on. There is a need for a residential safety which cannot be inadvertently thrown to a different position without an additional operation. This would prevent users from mistakenly throwing the switch either on or off. It would prevent accidents.

OBJECTS AND STATEMENT OF INVENTION

It is an object of this invention to disclose a residential safety switch which cannot be thrown in the same manner as other toggle switches. It is a further object of this invention to disclose a lever arm switch which requires a second operation to facilitate its use so that a user's attention must be directed specifically to the safety switch before they can flip it. It is yet a further object of this invention to disclose a safety switch which can be thrown with a single available hand. It is a final object of this invention to disclose a safety switch which is similar in design and appearance to standard switches so that minimal modifications will be required to manufacture the safety switch, and so that the safety switch can be used in standard outlet boxes, positioned under standard cover plates, and installed in the same manner.

In an electrical switch of the type having a front housing having a central frontal opening, a lever arm positioned within the front housing and projecting through the frontal opening, and a rear housing having a front side portion adapted to mate with the front housing the invention provides for a safety feature comprising: structure requiring an outward end portion of the lever arm to be pushed inwardly before it can be pivoted so that a user may, with a single hand, first depress the lever arm, and then pivot the lever arm between on and off position.

In one aspect of this invention the outer end portion of the lever arm which is depressed comprises a shaft having a button end and an opposite inner end portion. The inner end portion is connected to a lateral member having an end portion which is positioned within a circumferential notch in a stationary arcuate groove. The lever arm may only be moved between positions when the button end portion is depressed, moving the lateral member out of the circumferential notch into the arcuate groove where it may slide freely.

In another aspect of this invention the lever arm pivots about a lateral pivot member. The lateral member and surrounding housing which it pivots in are configured so that the lever arm may only be moved between positions when the lever arm in its entirety is pushed inwardly.

Various other objects, advantages and features of novelty which characterize this invention are pointed out with particularity in the claims which form part of this disclosure.

For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein:

FIG. 1 is a front view of a safety switch having a release button extending from an end of its lever arm.

Figure 2:
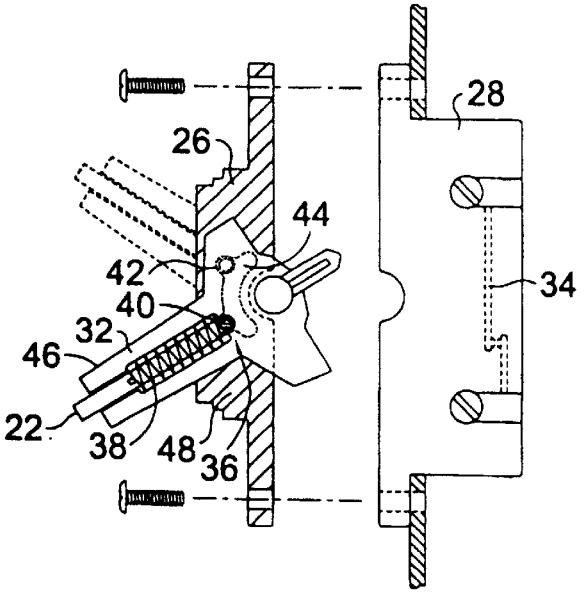

FIG. 2 is a cross sectional view of the switch shown in FIG. 1. The release button is the outer end portion of a shaft having an opposite inner end portion which is connected to a lateral member. The lateral member is positioned within a stationary arcuate groove having a circumferential notch.

Figure 3:
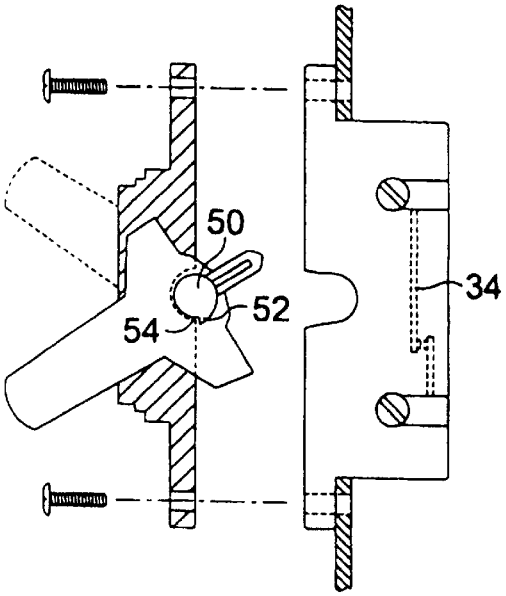

FIG. 3 shows an alternative embodiment of the safety switch. The lever arm has a lateral pivot member having a circumferential catch which is only disengaged from a mating receptor notch on the housing of the switch when an outward end portion of the lever arm is pressed inwardly.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a front view of a safety switch 20 having a release button 22 extending from an end of its lever arm 24. More generally, in an electrical switch 20 of the type having a front housing 26 having a central frontal opening 30, a lever arm 32 positioned within the front housing 26 and projecting through the frontal opening 30, and a rear housing 28 having a front side portion adapted to mate with the front housing 26, and a metal contact support 34 the invention comprises: structure 36 requiring an outward end portion of the lever arm 32 to be pushed inwardly before it can be pivoted so that a user may, with a single hand, first depress an outward end portion of the lever arm 32, and then pivot the lever arm 32 between on and off position.

FIG. 2 is a cross sectional view of the switch 20 shown in FIG. 1. The release button 22 is the outer end portion of a shaft 38 having an opposite inner end portion which is connected to a lateral member 40. Opposite end portions of the lateral member 40 are positioned within circumferential notches 42 of stationary arcuate grooves 44 on opposite inner sides of the front housing 32. The lever arm 32 may only be moved between positions when the release button 22 is depressed, moving the lateral member 40 out of the circumferential notches 42 into the arcuate groove 44 where it may slide freely.

Most preferably the shaft 38 is biased outwardly by a spring 46. Most preferably the arcuate groove 44 is in the front housing 26 and the notch 42 is in the outer side portion of the arcuate groove 44.

FIG. 3 shows an alternative embodiment of the safety switch 20. The lever arm 32 has a lateral pivot member 50 having a circumferential catch 52 which is only disengaged from a mating receptor notch 54 on the front housing 26 of the switch 20 when an outward end portion of the lever arm 32 is pressed inwardly. More generally the lateral pivot member 50 and surrounding housing 26 which it pivots in are configured so that the lever arm 32 may only be moved between positions when the lever arm 32 in its entirety is pushed inwardly.

The lever arm 32 is biased outwardly by a spring 46 which in this embodiment most preferably is the metal support 34 carrying an electrical contact.

In both embodiments of the invention shown in the figures, the front housing 26 has a peripheral lip 48 surrounding the lever arm 32 which projects therethrough. Most preferably this lip 48 is contrasting colored to the lever arm 32 so that the safety switch 20 may be identified when seen through a cover plate (not shown).

One aspect of the invention comprises a switch 20 which is notched 42 so that the outer button end portion 22 of the shaft 38 must be depressed to move the switch to a closed position (as shown in the solid lines in FIG. 2). Another aspect of the invention comprises a switch 20 which is notched 42 so that the outer button end portion 22 of the shaft 38 must be depressed to move the switch to an open position (as shown in the hidden lines in FIG. 2).

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. In an electrical switch of the type having a front housing portion having a central frontal opening, a lever arm positioned within the front housing portion and projecting through the frontal opening, and a mating rear housing portion, and a metal contact support, a safety feature comprising:

a release structure moving within, and in alignment with the lever arm so that the lever arm may be pivoted between on and off positions only when the release structure is first moved; and, so that a user may, with a single hand, first move the release structure within the lever arm, and then pivot the lever arm between on and off positions.

2. A switch as in claim 1 wherein the outer end portion of the release structure which is moved comprises a shaft having a release button end portion which is depressed and an opposite inner end portion connected to a lateral member having an end portion which is positioned within a circumferential notch of a stationary arcuate groove, the notch and groove both being positioned in a housing portion so that the lever arm may only be moved between positions when the button end portion is depressed, moving the lateral member out of the circumferential notch into the arcuate groove where the lateral member may slide freely.

3. A switch as in claim 2 wherein the shaft is biased outwardly by a spring positioned around the shaft in the lever arm.

4. A switch as in claim 3 wherein the arcuate groove is in the front housing portion.

5. A switch as in claim 4 wherein the arcuate groove has an outer front side portion and wherein the notch is in the outer front side portion of the arcuate groove.

6. A switch as in claim 4 wherein the front housing portion has a peripheral lip surrounding the lever arm projecting therethrough which is a contrasting color to the lever arm so that the peripheral lip identifies the switch when seen through a cover plate.

7. A switch as in claim 4 wherein the lateral member has two opposite end portions and further comprises a second notched arcuate groove, each of the two notched arcuate grooves on an opposite inner side of the front housing portion and each of the two opposite end portions being slidably positioned in one of the two notched arcuate grooves.

8. A switch as in claim 2 wherein the arcuate groove is notched so that the release button end portion of the shaft must be depressed to move the switch to an on position.

9. A switch as in claim 2 wherein the arcuate groove is notched so that the release button end portion of the shaft must be depressed to move the switch to an off position.

10. In an electrical switch of the type having a front housing portion having a central frontal opening, a lever arm positioned within the front housing portion and projecting through the frontal opening, and a mating rear housing portion, a metal contact support, structure requiring an outward end portion of the lever arm to be moved longitudinally before the lever arm can be pivoted so that a user may, with a single hand, first longitudinally move the lever arm, and then pivot the lever arm between on and off positions, and a spring biasing the lever arm, the improvement comprising:

the lever arm being biased by a spring which comprises the metal contact support.

11. A switch as in claim 10 wherein the lateral member has opposite end portions and each of the opposite end portions turns in an opposite inner side of the front housing.

12. A switch as in claim 10 further comprising a lateral pivot member which the lever arm pivots about and wherein the lateral pivot member and housing portions which it pivots in are configured so that the lever arm may only be moved between positions when the lever arm is pushed inwardly.

13. A switch as in claim 12 wherein one of the lateral member and the frontal housing portion which it pivots in have a peripheral radially extending catch and wherein the other has a mating notch so that the lever arm may not be rotated until it is pushed radially inwards disengaging the catch from the notch.

14. A switch as in claim 13 configured so that the outward end portion of the lever arm must be depressed to move the switch to an on position.

15. A switch as in claim 13 configured so that the outward end portion of the lever arm must be depressed to move the switch to an off position.

16. A switch as in claim 13 wherein the front housing portion has a peripheral lip surrounding the central lever arm and wherein the front housing portion is a contrasting color so that the peripheral lip defines the switch when the lip is seen through a cover plate.

* * * * *